US007876185B2

(12) United States Patent
Trinh et al.

(10) Patent No.: US 7,876,185 B2
(45) Date of Patent: Jan. 25, 2011

(54) ELECTROMAGNETIC SWITCH

(75) Inventors: An Dan Trinh, Orange, CA (US); Kiem Cong Trinh, Cypress, CA (US)

(73) Assignee: Teledyne Technologies Incorporated, Thousand Oaks, CA (US)

( * ) Notice: Subject to any disclaimer, the term of this patent is extended or adjusted under 35 U.S.C. 154(b) by 251 days.

(21) Appl. No.: 12/115,304

(22) Filed: May 5, 2008

(65) Prior Publication Data

US 2009/0273420 A1 Nov. 5, 2009

(51) Int. Cl.
*H01H 7/08* (2006.01)

(52) U.S. Cl. ..... 335/220; 335/5; 335/177

(58) Field of Classification Search ..... 335/4, 335/5, 126, 131, 177, 220–229
See application file for complete search history.

(56) References Cited

U.S. PATENT DOCUMENTS

| | | | |
|---|---|---|---|
| 2,544,719 | A | 3/1951 | O'Brien et al. |
| 2,941,164 | A | 1/1957 | Lanctot |
| 2,997,669 | A | 8/1961 | Charles |
| 3,019,402 | A | 1/1962 | Lanctot |
| 3,021,408 | A | 2/1962 | Jennings |
| 3,319,194 | A | 5/1967 | Adam |
| 3,487,342 | A | 12/1969 | Gibson et al. |
| 3,569,877 | A | 3/1971 | Robbins et al. |
| 3,600,542 | A | 8/1971 | Richter |
| 3,626,352 | A | 12/1971 | McCoig |
| 3,681,719 | A | 8/1972 | Treschitta et al. |
| 3,694,777 | A | 9/1972 | Muller |
| 3,739,306 | A | 6/1973 | Sladek |
| 3,971,024 | A | 7/1976 | Clark, Jr. et al. |
| 4,081,772 | A | 3/1978 | Schuessler et al. |
| 4,101,855 | A | 7/1978 | Drapeau |
| 4,109,222 | A | 8/1978 | Frano et al. |
| 4,298,847 | A | 11/1981 | Hoffman |
| 4,496,919 | A | 1/1985 | Fournier et al. |
| 4,633,118 | A | 12/1986 | Kosugi |

(Continued)

FOREIGN PATENT DOCUMENTS

EP 0451975 A2 10/1991

(Continued)

OTHER PUBLICATIONS

Nais, SMD Relays With 5GHz Capabilities.

(Continued)

*Primary Examiner*—Anh T Mai
*Assistant Examiner*—Bernard Rojas
(74) *Attorney, Agent, or Firm*—K&L Gates LLP

(57) ABSTRACT

An electromechanical switch may be actuated in a plurality of modes. A base portion of the electromechanical switch includes first and second electrical ports adapted to be electrically coupled in a plurality of modes. A first electromagnetic coil defines a longitudinal axis and is adapted to receive a first energizing current. A second electromagnetic coil extends along the longitudinal axis in spaced apart relationship with the first electromagnetic coil. The second electromagnetic coil is adapted to receive a second energizing current. The first and second ports are selectively coupled in any one of open-terminated mode, attenuation mode, and a short circuit mode based on the energy state of the first and second electromagnetic coils.

25 Claims, 6 Drawing Sheets

U.S. PATENT DOCUMENTS 4,697,056 A 9/1987 Hoffman
4,855,699 A 8/1989 Hoegh
4,908,588 A 3/1990 Hoffman et al.
5,025,237 A 6/1991 Yamazaki et al.
5,025,922 A 6/1991 Havens et al.
5,063,364 A 11/1991 Tsoi
5,065,125 A 11/1991 Thomson et al.
5,075,656 A 12/1991 Sun et al.
5,142,690 A 8/1992 McMullan, Jr. et al.
5,246,376 A 9/1993 Schuhl et al.
5,281,936 A 1/1994 Ciezarek
5,315,273 A 5/1994 Blair et al.
5,422,617 A * 6/1995 Brown ..... 335/267
5,451,918 A 9/1995 Sun et al.
5,712,690 A 1/1998 Kim
5,815,057 A 9/1998 Hoffman et al.
5,892,422 A * 4/1999 Montaigu et al. ..... 335/126
5,894,255 A 4/1999 Wallintin
6,043,440 A 3/2000 Sun et al.
6,097,441 A 8/2000 Allport
6,137,539 A 10/2000 Lownes et al.
6,211,756 B1 4/2001 Sun et al.
6,650,210 B1 * 11/2003 Raklyar et al. ..... 335/4
6,677,844 B1 * 1/2004 Gorospe et al. ..... 335/220
6,740,413 B2 5/2004 Klun et al.
6,809,255 B1 10/2004 Chun

FOREIGN PATENT DOCUMENTS

GB 2013409 A 8/1979
WO WO 95/30996 A1 11/1995
WO WO 00/16355 A1 3/2000
WO WO 00/28564 A1 5/2000

OTHER PUBLICATIONS

International Search Report and Written Opinion for PCT/US2008/054275, Aug. 12, 2008, corrected version (16 pages).
International Search Report and Written Opinion for PCT/US2008/054275, Jul. 10, 2008 (15 pages).
W. Little et al.: "The Shorter Oxford English Dictionary," vol. II, p. 1961, Clarendon Press, Oxford, 1973.
Teledyne Relays Series RF310, RF313 Brochure, 1997.
Teledyne Relays Series RF320, RF323 Brochure, 1997.
Teledyne Relays Series RF300, RF303 Brochure, 1994.
U.S. Appl. No. 11/804,618, filed May 18, 2007.
ISR and Written Opinion, PCT/US2009/042345, Apr. 30, 2009.

* cited by examiner

ELECTROMAGNETIC SWITCH

BACKGROUND

The present disclosure is directed generally to electromagnetic switches.

Electromagnetic switches are employed in modern electronic test equipment such as digital signal oscilloscopes, spectrum analyzers, data analyzers, and vector analyzers, for example. Modern electronic test equipment, such as microwave signal analyzers, operate at broadband frequencies from direct current (DC) up into the gigahertz (GHz) range. Such broadband electronic test equipment requires multi-mode switching devices to direct microwave (e.g., millimeter wave) signals with minimum loss, to attenuate incoming signals hundreds of times below their original power level before processing, and to interrupt input signals with minimum crosstalk during system calibration cycles. Each of these tasks requires a complex setup of switching devices. Accordingly, there is a need for an electromagnetic switch that may be actuated in various modes to satisfy complex switching functions.

SUMMARY

In one embodiment an electromagnetic switch comprises first and second ports adapted to receive an electrical signal. A first solenoid defines a longitudinal axis. The first solenoid is adapted to receive a first energizing current. A second solenoid is positioned along the longitudinal axis. The second solenoid is adapted to receive a second energizing current. The first and second solenoids are adapted to selectively engage first, second, and third electrical contact elements to selectively couple the first and second ports to an impedance element based on the energy state of the first and second solenoids.

DESCRIPTION

Figure 1:
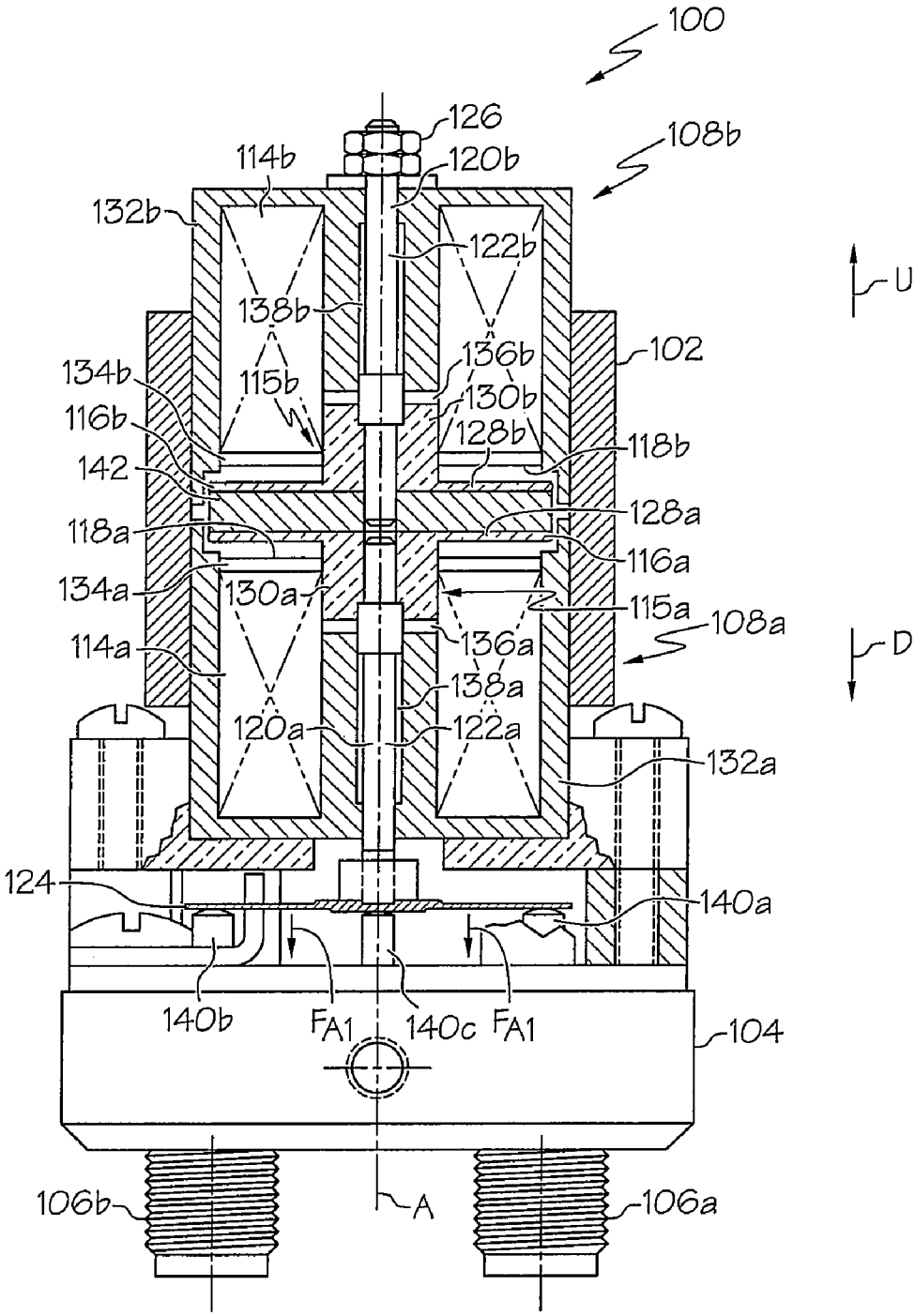
FIG. 1 is a partial cross-sectional view of one embodiment of an electromagnetic switch comprising first and second electromagnetic coils in a de-energized state connecting first and second input/output interface ports in open-terminated mode.
Figure 4:
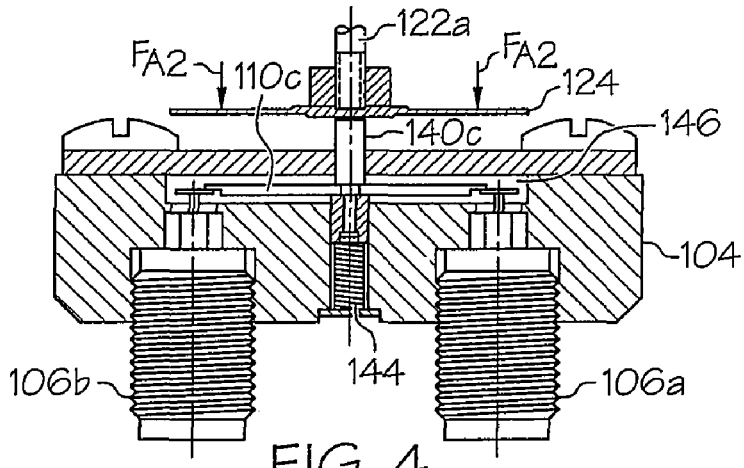
FIG. 4 is a partial cross-sectional front view of the base portion of one embodiment of the electromagnetic switch shown in FIG. 1.
Figure 5:
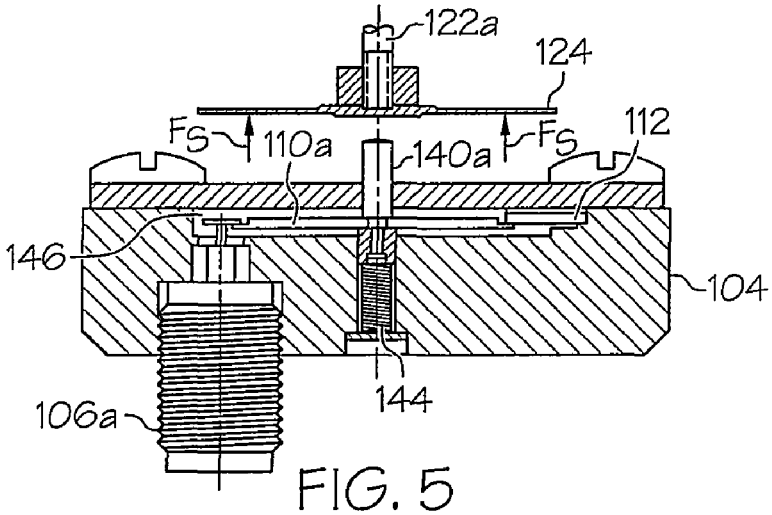
FIG. 5 is a partial cross-sectional side view of the base portion of one embodiment of the electromagnetic switch shown in FIG. 1.
Figure 6:
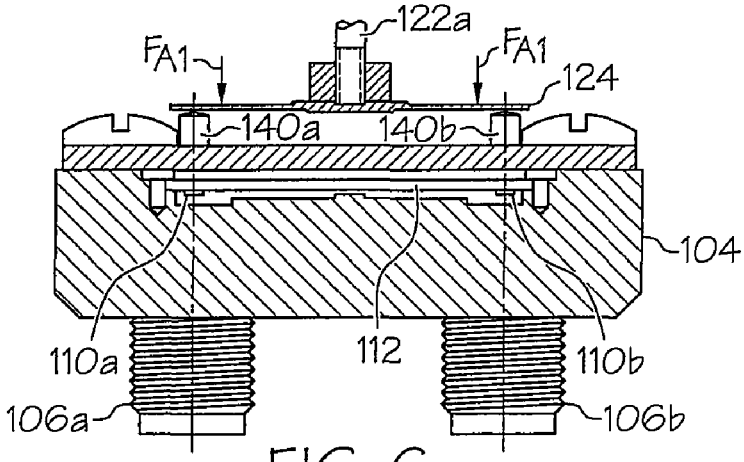
FIG. 6 is a partial cross-sectional rear view of the base portion of one embodiment of the electromagnetic switch shown in FIG. 1.

FIG. 1 is a partial cross-sectional view of one embodiment of an electromagnetic switch 100. FIG. 4 is a partial cross-sectional front view of the base portion of one embodiment of the electromagnetic switch 100 shown in FIG. 1. FIG. 5 is a partial cross-sectional side view of the base portion of one embodiment of the electromagnetic switch 100 shown in FIG. 1. FIG. 6 is a partial cross-sectional rear view of the base portion of one embodiment of the electromagnetic switch 100 shown in FIG. 1. With reference to FIGS. 1 and 4-6, in one embodiment, the electromagnetic switch 100 comprises a housing 102 including a radio frequency (RF) base portion 104 comprising a first input/output interface port 106*a* and a second input/output interface port 106*b*. The electromagnetic switch 100 also comprises a first solenoid 108*a* and a second solenoid 108*b*, three electrical contact elements 110*a*, 110*b*, 110*c* (FIGS. 4-6) and an impedance element 112 (FIG. 5). In one embodiment, the first and second input/output interface ports 106*a, b* may be coaxial RF connectors such as subminiature version A (SMA) connectors. In one embodiment, the first and second input/output interface ports 106*a, b* may be implemented as jack type versions of the SMA RF connectors. The first, second, and third electrical contact elements 110*a-c* can selectively switch microwave signals from DC to about 25 GHz between the input/output interface ports 106*a, b* in three different modes: open-terminated mode, attenuated mode, and through mode based on the energy state of the first and second solenoids 108*a, b*.

The first solenoid 108*a* defines a longitudinal axis "A" and is adapted to receive a first energizing current. The second solenoid 108*b* is positioned along the longitudinal axis "A" and is adapted to receive a second energizing current. The first and second solenoids 108*a, b* are adapted to engage the first, second, and third electrical contact elements 110*a-c* (FIGS. 4-6). The impedance element 112 (FIG. 5) may be selectively coupled between the first and second input/output interface ports 106*a, b* based on the energy state of the first and second solenoids 108*a, b*.

In one embodiment, the first solenoid 108*a* comprises a first electromagnetic coil 114*a*, a first ferromagnetic core 132*a*, a first armature 115*a*, and a first piston 120*a*. The first electromagnetic coil 114*a* is positioned along the longitudinal axis "A" and is adapted to receive the first energizing current. The first ferromagnetic core 132*a* comprises a first opening 134*a* adapted to fixedly receive the first electromagnetic coil 114*a* therein. The first ferromagnetic core 132*a* also comprises a second opening 136*a* and a third opening 138*a* extending along the longitudinal axis "A." The first armature 115*a* is movable along the longitudinal axis "A" relative to the first electromagnetic coil 114*a*. When the first electromagnetic coil 114*a* is energized, the first armature 115*a* moves to a first stroke end position 118*a*. The first armature 115*a* comprises a first ferromagnetic element 116*a* comprising an axial portion 130*a* extending along the longitudinal axis "A" and a radial portion 128*a* to engage a first surface at the first stroke end position 118*a*. The axial portion 130*a* is slidably receivable within the second opening 136*a* of the first ferromagnetic core 132*a*. The first piston 120*a* extends along the longitudinal axis "A" and is coupled to the first armature 115*a*. The first piston 120*a* comprises a first rod 122*a* having a first end and a second end and an actuator member 124 extending substantially perpendicular from the longitudinal axis "A." The first end of the first rod 122*a* is attached to the actuator member 124. The second end of the first rod 122*a* is attached to the axial portion 130*a* of the first ferromagnetic element 116*a*. A portion of the first rod 122*a* is slidably receivable within the third opening 138*a* of the first ferromagnetic core 132*a*.

The actuator member 124 is adapted to selectively engage the first, second, and third electrical contact elements 110*a-c* (FIGS. 4-6) based on the energy state of the first and second solenoids 108*a, b*. First, second, and third dielectric carriers 140*a*, 140*b*, 140*c* each comprise a first end adapted to engage the respective first, second, and third electrical contact elements 110*a-c* and a second end adapted to be engaged by the actuator member 124. The actuator member 124 applies a force $F_{A1}$ to the second end of the first, second, and third dielectric carriers 140*a-c*. Each of the first, second, and third dielectric carriers 140*a-c* selectively transfer the actuation force imparted by the actuator member 124 to the respective first, second, and third electrical contact elements 110*a-c* based on the energy state of the first and second electromagnetic coils 114*a, b*.

In one embodiment, a cavity 146 is formed within the base portion 104 to house the first, second, and third electrical contact elements 110*a-c*, the corresponding portions of the first, second, and third dielectric carriers 140*a-c*, and the impedance element 112 (FIG. 5). In one embodiment, the body portion 104 is a square aluminum housing with sides having a length of 1.2 inches. In one embodiment, the first and second electrical contact elements 110*a*, 110*b* are vertically oriented within the cavity 146. The vertically oriented first and second electrical contact elements 110*a, b* are reeds positioned in a lower configuration. The first electrical contact element 110*a* has a length of about 0.6 inches and a height of about 0.3 inches. The first dielectric carrier 140*a* has a diameter of about 0.07 inches and is located at the center of the first electrical contact element 110*a*. The second electrical contact element 110*b* has a length of about 0.6 inches and a height of about 0.315 inches. The second dielectric carrier 140*a* has a diameter of about 0.07 inches and is located at the center of the second electrical contact element 110*b*. The third electrical contact element 110*c* is positioned in an upper configuration and horizontally oriented within the cavity 146. In one embodiment, the horizontal electrical contact element 110*c* comprises a reed having a length of about 0.6 inches, a height of about 0.3 inches, and the dielectric carrier 140*c* having a diameter of about 0.07 inches diameter located at its center. The physical characteristics of the third electrical contact element are similar to the first electrical contact element 110*a*.

In one embodiment, the second solenoid 108*b* comprises a second electromagnetic coil 114*b*, a second ferromagnetic core 132*b*, a second armature 115*b*, and a second piston 120*b*. The second electromagnetic coil 114*b* extends along the longitudinal axis "A" in spaced apart relationship with the first electromagnetic coil 108*a* and is adapted to receive the first energizing current. The second ferromagnetic core 132*b* comprises a first opening 134*b* adapted to fixedly receive the second electromagnetic coil 114*b* and a second opening 136*b* and a third opening 138*b*, each extending along the longitudinal axis "A." The second armature 115*b* is movable along the longitudinal axis "A" relative to the second electromagnetic coil 114*b* to a second stroke end position 118*b* when the second electromagnetic coil 114*b* is energized. The second armature 115*b* comprises a second ferromagnetic element 116*b* comprising an axial portion 130*b* extending along the longitudinal axis "A" and a radial portion 128*b* to engage a second surface at the second stroke end position 118*b*. The second armature 115*b* is separated from the first armature 115*a* by a magnetic isolator element 142. For conciseness and clarity, the combination of the first and second armatures 115*a, b* may be referred to as the armature or movable armature, and the combination of the first and second armatures 115*a, b* and the magnetic isolator element 142 also may be referred to as the armature or movable armature, without departing from the scope of the embodiment. The axial portion 130*b* is slidably receivable within the second opening 136*b* of the second ferromagnetic core 132*b*. The second piston 120*b* extends along the longitudinal axis "A" and is coupled to the first armature 115*a*. The second piston 120*b* comprises a second rod 122*b* having a first end and a second end. The first end of the second rod 122*b* is attached to a stroke limit element 126. The second end of the second rod 122*b* is attached to the axial portion 130*b* of the second ferromagnetic element 116*b*. A portion of the second rod 122*b* is slidably receivable within the third opening 138*b* of the second ferromagnetic core 132*b*.

Figure 2:
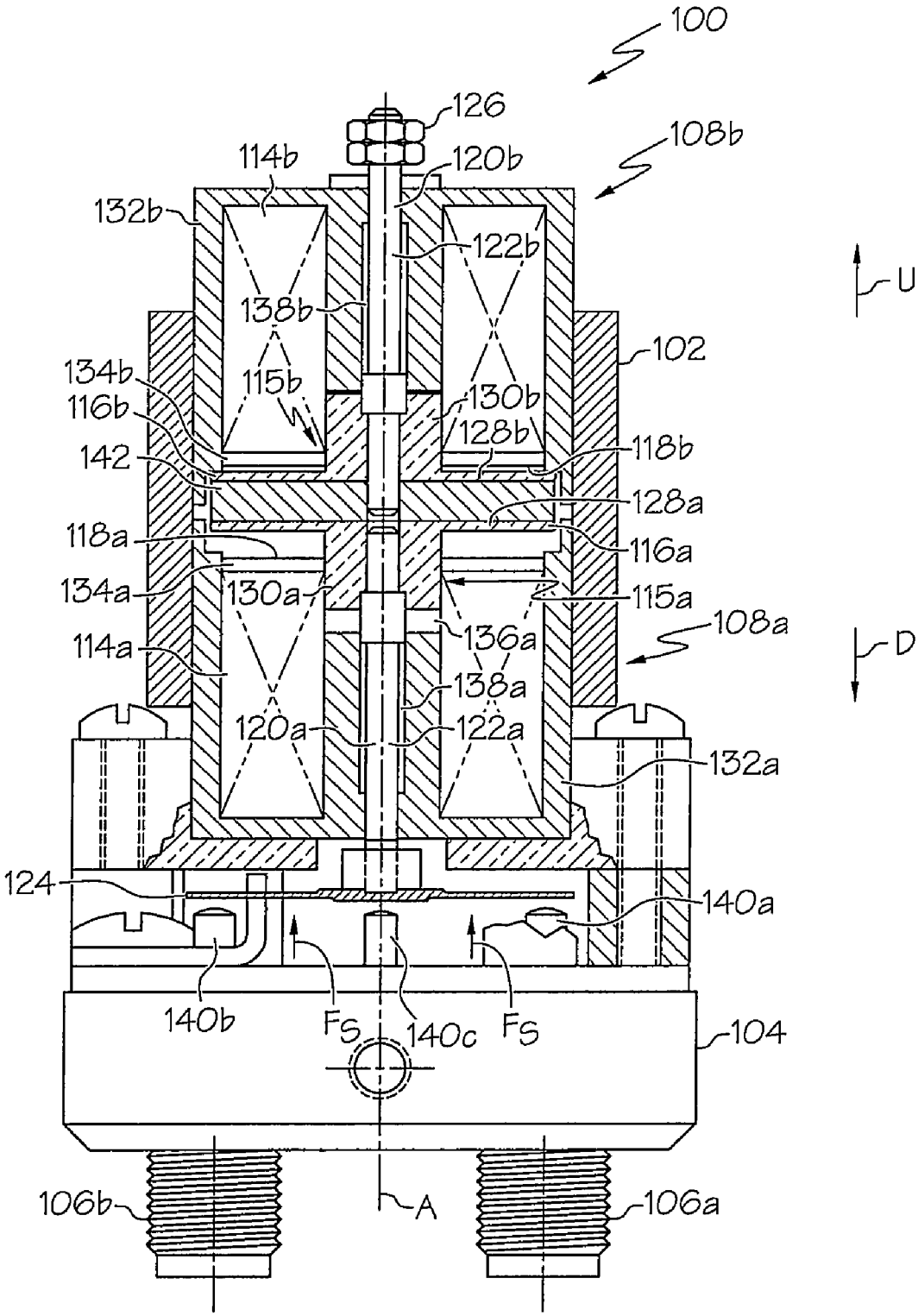
FIG. 2 is a partial cross-sectional view of one embodiment of the electromagnetic switch shown in FIG. 1 with the first electromagnetic coil in a de-energized state and the second electromagnetic coil in an energized state connecting the first and second input/output interface ports in attenuated mode.
Figure 3:
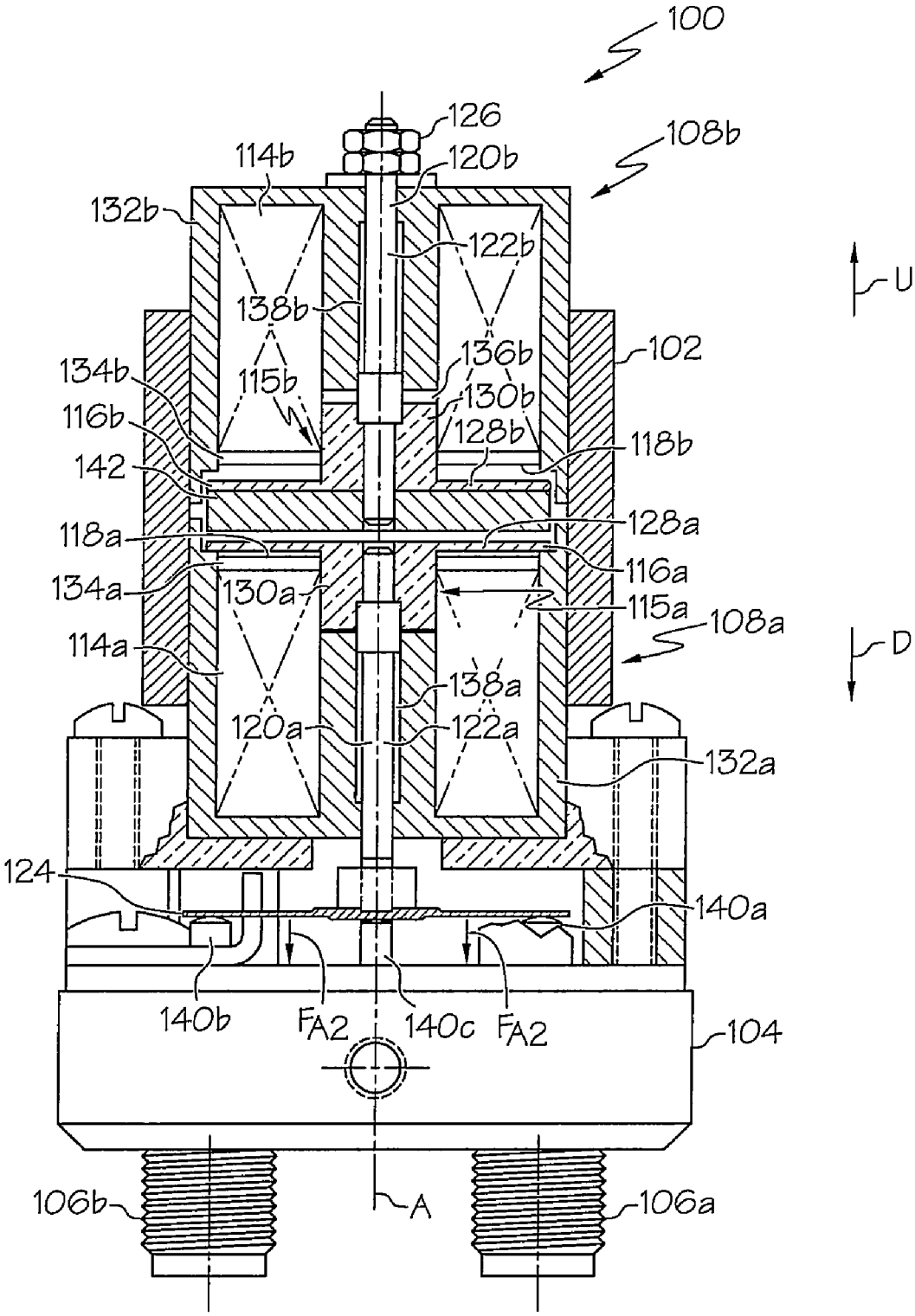
FIG. 3 is a partial cross-sectional view of one embodiment of the electromagnetic switch shown in FIG. 1 with the first electromagnetic coil in an energized state and the second electromagnetic coil in a de-energized state connecting the first and second input/output interface ports in through mode.

In operation, the electromagnetic switch 100 is actuated by driving the first and second solenoids 108*a, b* in a predetermined manner. The first and second solenoids 108*a, b* are positioned in tandem and reverse acting as shown in FIGS. 1-3 with the second solenoid 108*b* positioned above the first solenoid 108*a*. The first and second electromagnetic coils 114*a, b* may be driven with energizing currents (e.g., $I_1$ and $I_2$ FIGS. 7-9) and thus are actuated in opposite directions. The first piston 120*a* of the first solenoid 108*a* is driven in the direction indicated by arrow "D" when a first energizing current is applied to the first electromagnetic coil 114*a*. The second piston 120*b* of the second solenoid 108*b* is driven in the direction indicated by arrow "U" when a second energizing current is applied to the second electromagnetic coil 114*b*.

As shown in FIG. 1, the first and second electromagnetic coils 114*a, b* are both in a de-energized state with no energizing current applied thereto. The armatures 115*a, b* are positioned between the first stroke end position 118*a* and the second stroke end position 118*b*. The first electrical contact element 110*a* is coupled to the impedance element 112 and the first port 106*a*. The second electrical contact element 110*b* is decoupled from the impedance element 112 and the second port 106*b*. In this energy state, the second piston 120*b* partially pushes on the first end of the first piston 120*a*. The actuator member 124 engages the second end of the second dielectric carrier 140*b* and applies force $F_{A1}$ thereto in direction "D." The force is sufficient to create a small gap and electrically open the second electrical contact element 110*b*. The force $F_{A1}$ is not sufficient for the actuator member 124 to engage the second end of the first and third dielectric carriers 140*a, c* because the height of the first and third dielectric carriers 140*a, c* is shorter than the height of the second dielectric carrier 140*b*. The impedance element 112 presents a shunt resistance with a 50 Ohm termination effect to the first input/output interface port 106*a*. This mode may be referred to as "open-terminated mode" or simply as "open" mode. Accordingly, the first and second input/output interface ports 106*a, b* are selectively coupled in open-terminated mode.

FIG. 2 is a partial cross-sectional view of one embodiment of the electromagnetic switch 100 shown in FIG. 1 with the first electromagnetic coil 114*a* in a de-energized state and the second electromagnetic coil 114*b* in an energized state. In this energy state, the second armature 115*b* is positioned at the second stroke end position 118*b*. The first and second electrical contact elements 110*a, b* are coupled to the impedance element 112. In one embodiment, the impedance element 112 provides 20 dB of attenuation. When the second electromagnetic coil 114*b* is energized, both the first and second pistons 120*a, b* retract in direction "U" and the actuator member 124 disengages the second ends of the first, second, and third dielectric carriers 140*a-c*. The first, second, and third electrical contact elements 110*a-c* return to their unloaded position by a force $F_S$ applied by a spring 144 (FIG. 5) in direction "U." The first and second electrical contact elements 110*a, b* are coupled to the impedance element 112. Accordingly, the first and second input/output interface ports 106*a, b* are selectively coupled in attenuated mode. This mode may be referred to as an "attenuated path" or "high loss path" by those skilled in the art.

FIG. 3 is a partial cross-sectional view of one embodiment of the electromagnetic switch 100 shown in FIG. 1 with the first electromagnetic coil 114*a* in an energized state and the second electromagnetic coil 114*b* in a de-energized state. In this energy state, the armature 115*a* is positioned at the first stroke end position 118*a* and the first and second electrical contact elements 110*a, b* are coupled to the third electrical contact element 110*c*. When the first electromagnetic coil 114*a* is energized and the second electromagnetic coil 114*b* is de-energized, the first piston 120*a* moves in direction "D" and the actuator member 124 engages the first end of the first, second, and third dielectric carriers 140*a-c*. The actuator member 124 applies a suitable force $F_{A2}$ such that the first and second electrical contact elements 110*a, b* couple to the third electrical contact element 110*c*. The first and second input/output interface ports 106*a, b* are coupled to the third electrical contact element 110*c*. Accordingly, the first and second input/output interface ports 106*a, b* are selectively coupled in through mode. This mode may be referred to as a "through path," "zero loss path," or "short circuit path" by those skilled in the art.

Figure 9:
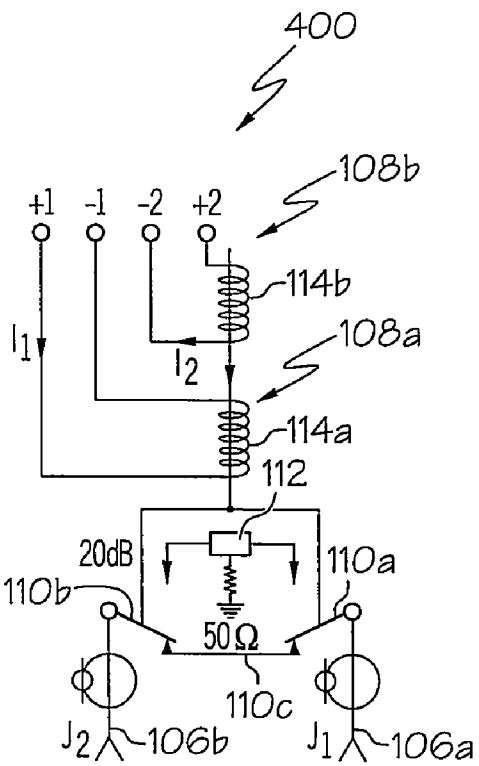
FIG. 9 is a circuit schematic diagram of one embodiment of the electromagnetic switch shown in FIG. 1 in through mode.
Figure 8:
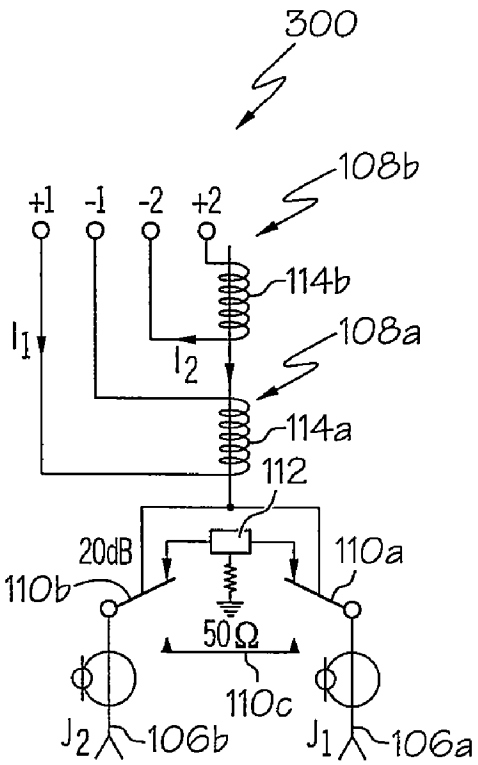
FIG. 8 is a circuit schematic diagram of one embodiment of the electromagnetic switch shown in FIG. 1 in attenuated mode.
Figure 7:
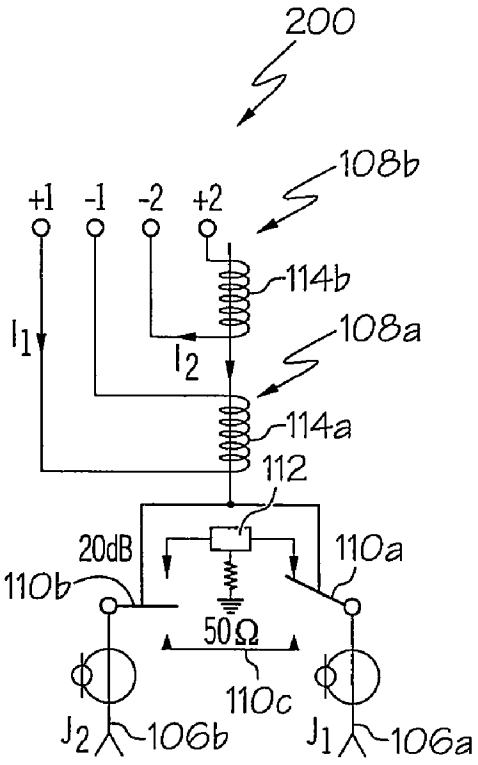
FIG. 7 is a circuit schematic diagram of one embodiment of the electromagnetic switch shown in FIG. 1 in open-terminated mode.

FIGS. 7-9 are circuit schematic diagrams 200, 300, 400 of one embodiment of the electromagnetic switch 100 shown in FIG. 1 in respective open-terminated mode, attenuated mode, and through mode. Signals from DC to RF frequencies (e.g., 0 to about 25 GHZ) are received at either the first input/output interface port 106*a* or the second input/output interface port 106*b*. A first energizing current $I_1$ may be applied to the first solenoid 108*a* via input terminals +1 and −1. The first energizing current $I_1$ is driven through the first electromagnetic coil 114*a*. A second energizing current $I_2$ may be applied to the second solenoid 108*b* via input terminals +2 and −2. The second energizing current $I_2$ is driven through the second electromagnetic coil 114*b*.

FIG. 7 is a circuit schematic diagram 200 of the electromagnetic switch 100 in "open-terminated mode." No energizing current is applied to the first and second electromagnetic coils 114*a, b* and thus the first and second electromagnetic coils 114*a, b* are both de-energized. Thus, $I_1$ and $I_2$ are both zero. In this energy state, the first electrical contact element 110*a* is coupled to the impedance element 112 and the first input/output interface port 106*a*. The second electrical contact element 111*b* is decoupled from the impedance element 112 and the second input/output interface port 106*b*. The impedance element 112 presents a shunt resistance with a 50 Ohm termination effect to the first input/output interface port 106*a*. Accordingly, the first and second input/output interface ports 106*a, b* are selectively coupled in open-terminated mode.

FIG. 8 is a circuit schematic diagram 300 of one embodiment of the electromagnetic switch 100 shown in FIG. 1 in attenuated mode. The first electromagnetic coil 114*a* is de-energized with $I_1$ being zero and the second electromagnetic coil 114*b* is energized with $I_2$ being non-zero. In this energy state, the first and second electrical contact elements 10*a, b* are coupled to the impedance element 112. In one embodiment, the impedance element 112 provides 20 dB of attenuation. Accordingly, the first and second input/output interface ports 106*a, b* are selectively coupled in attenuation mode.

FIG. 9 is a circuit schematic diagram 400 of one embodiment of the electromagnetic switch 100 shown in FIG. 1 in through mode. The first electromagnetic coil 114*a* is energized with $I_1$ being non-zero and the second electromagnetic coil 114*b* is de-energized with $I_2$ being zero. In this energy state, the first and second electrical contact elements 110*a, b* are coupled to the third electrical contact element 110*c*. Accordingly, the first and second ports 106*a, b* are selectively coupled in the short circuit mode.

Figures 10, 11, 12:
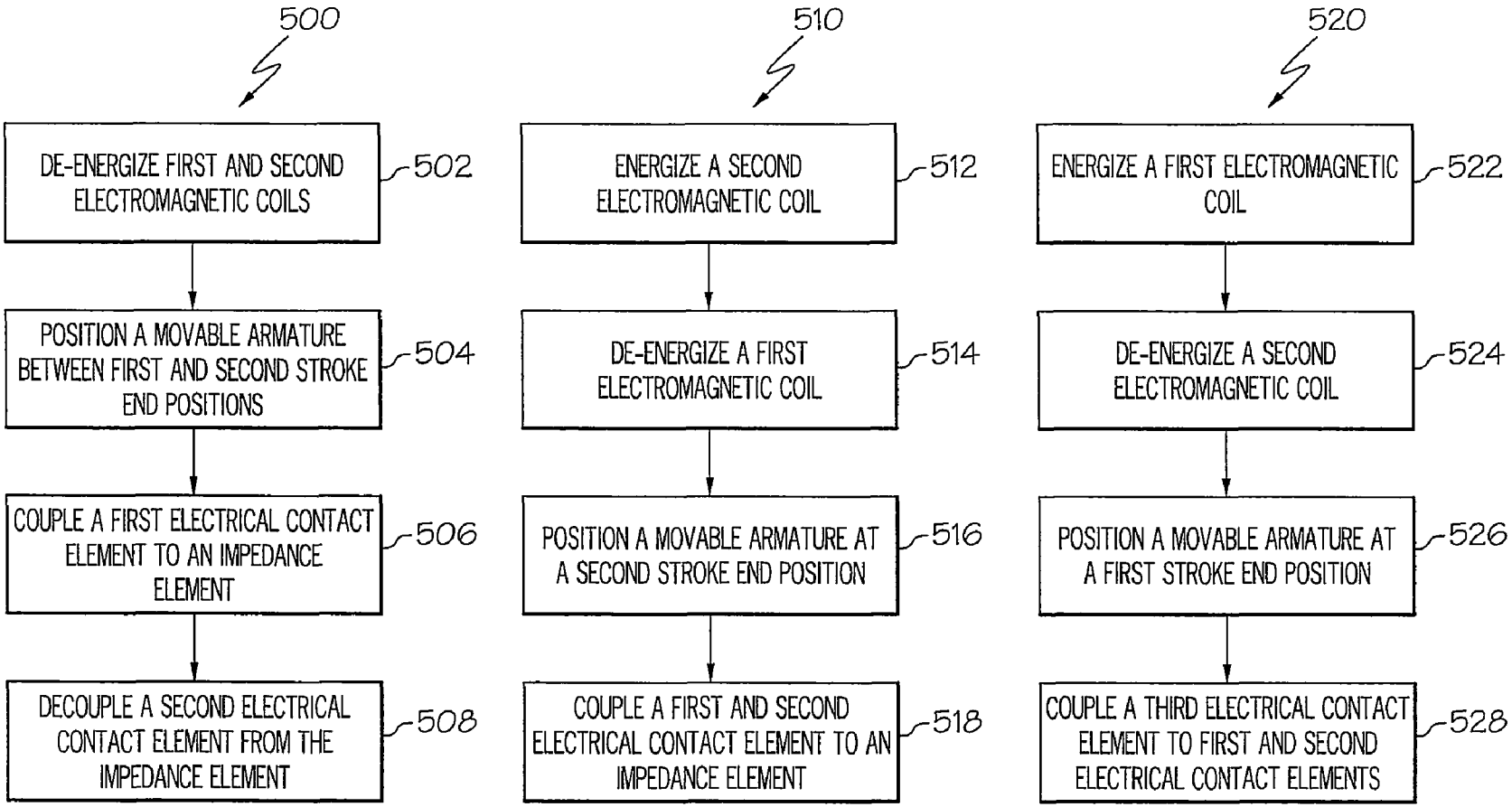
FIG. 10 is a diagram to illustrate the operation of one embodiment of the electromagnetic switch shown in FIG. 1 in open-terminated mode.
FIG. 11 is a diagram to illustrate the operation of one embodiment of the electromagnetic switch 100 shown in FIG. 1 in attenuated mode.
FIG. 12 is a diagram to illustrate the operation of one embodiment of the electromagnetic switch 100 shown in FIG. 1 in through mode.

FIG. 10 is a diagram 500 to illustrate the operation of one embodiment of the electromagnetic switch 100 shown in FIG. 1 in open-terminated mode. Accordingly, the first and second electromagnetic coils 114*a, b* are de-energized 502 to position 504 the movable armature 115*a, b* between the first stroke end position 118*a* and the second stroke end position 118*b* in response to de-energizing the first and second electromagnetic coils 114*a, b*. The first electrical contact element 110*a* is coupled 506 to the impedance element 112. The second electrical contact element 110*b* is decoupled 508 from the impedance element 112.

FIG. 11 is a diagram 510 to illustrate the operation of one embodiment of the electromagnetic switch 100 shown in FIG. 1 in attenuated mode. Accordingly, the second electromagnetic coil 114*b* is energized 512 and the first electromagnetic 114*a* coil is de-energized 514. The movable armature 115*b* is positioned 516 at the second stroke end position 118*b*. The first and second electrical contact elements 110*a, b* are coupled 518 to the impedance element 112.

FIG. 12 is a diagram 520 to illustrate the operation of one embodiment of the electromagnetic switch 100 shown in FIG. 1 in through mode. Accordingly, the first electromagnetic coil 114*a* is energized 522 and the second electromagnetic 114*b* coil is de-energized 524. The movable armature 118*a* is positioned 526 at the first stroke end position 118*a*. The third electrical contact element 110*c* is coupled 528 to the first and second electrical contact elements 110*a, b*.

Numerous specific details have been set forth herein to provide a thorough understanding of the embodiments. It will be understood by those skilled in the art, however, that the embodiments may be practiced without these specific details. In other instances, well-known operations, components and circuits have not been described in detail so as not to obscure the embodiments. It can be appreciated that the specific structural and functional details disclosed herein may be representative and do not necessarily limit the scope of the embodiments.

It is also worthy to note that any reference to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

Some embodiments may be described using the expression "coupled" and "connected" along with their derivatives. It should be understood that these terms are not intended as synonyms for each other. For example, some embodiments may be described using the term "connected" to indicate that two or more elements are in direct physical or electrical contact with each other. In another example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

While certain features of the embodiments have been illustrated as described herein, many modifications, substitutions, changes and equivalents will now occur to those skilled in the art. It is therefore to be understood that the appended claims are intended to cover all such modifications and changes as fall within the true scope of the embodiments.

The invention claimed is:

1. An electromechanical switch, comprising;

a base portion comprising first and second electrical ports adapted to be electrically coupled in a plurality of modes;

a first electromagnetic coil defining a longitudinal axis and adapted to receive a first energizing current;

a second electromagnetic coil extending along the longitudinal axis in spaced apart relationship with the first electromagnetic coil, the second electromagnetic coil adapted to receive a second energizing current;

an armature movable along the longitudinal axis relative to the first and second electromagnetic coils between a first stroke end position and a second stroke end position;

a piston extending along the longitudinal axis coupled to the armature, the piston comprising a first rod having a first end and a second end and an actuator member extending substantially perpendicular from the longitudinal axis attached to the first end of the first rod;

a first electrical contact element coupled to the first electrical port, the first electrical contact element is moveable from a first position to at least a second position in response to a force applied by the actuator member;

a second electrical contact element coupled to the second electrical port, the second electrical contact element is moveable from a first position to at least a second position in response to a force applied by the actuator member;

a third electrical contact element to couple to at least one of the first and second electrical contact elements; and first, second, and third dielectric carriers, each comprising a first end adapted to engage the respective first, second, and third electrical contact elements and a second end adapted to be engaged by the actuator member, each of the first, second, and third dielectric carriers selectively transfer an actuation force imparted by the actuator member to the first, second, and third electrical contact elements based on the energy state of the first and second electromagnetic coils;

wherein the first and second ports are selectively coupled in any one of open-terminated mode, attenuation mode, and a short circuit mode based on the energy state of the first and second electromagnetic coils.

2. The electromagnetic switch of claim 1, wherein, when the first and second electromagnetic coils are de-energized, the armature is positioned between the first stroke end position and the second stroke end position, the first electrical contact element is coupled to an impedance element, the second electrical contact element is decoupled from the impedance element, and the first and second ports are selectively coupled in the open-terminated mode.

3. The electromagnetic switch of claim 1, wherein, when the second electromagnetic coil is energized and the first electromagnetic coil is de-energized, the armature is positioned at the second stroke end position, the first and second electrical contact elements are coupled to the impedance element, and the first and second ports are selectively coupled in the attenuation mode.

4. The electromagnetic switch of claim 1, wherein, when the first electromagnetic coil is energized and the second electromagnetic coil is de-energized, the armature is positioned at the first stroke end position, the first and second electrical contact elements are coupled to the third electrical contact element, and the first and second ports are selectively coupled in the short circuit mode.

5. The electromagnetic switch of claim 1, wherein, when the first and second electromagnetic coils are de-energized, the actuator member engages the second end of the second dielectric carrier to decouple the second electrical contact element from the second port and disengages the second ends of the first and third dielectric carriers to selectively couple the first electrical contact element to the impedance element and the first port.

6. The electromagnetic switch of claim 1, wherein, when the first electromagnetic coil is de-energized and the second electromagnetic coil is energized, the actuator member disengages the second ends of the first, second, and third dielectric carriers to selectively couple the first and second ports to an impedance element.

7. The electromagnetic switch of claim 1, wherein, when the first electromagnetic coil is energized and the second electromagnetic coil is de-energized, the actuator member engages the second ends of the first, second, and third dielectric carriers to selectively couple the first and second ports to the third electrical contact element.

8. The electromagnetic switch of claim 1, wherein the armature comprises:

a first ferromagnetic element comprising an axial portion extending along the longitudinal axis and a radial portion extending substantially perpendicular to the longitudinal axis to engage a first surface at the first stroke end position, the axial portion of the first ferromagnetic element is attached to the second end of the first rod;

a second ferromagnetic element comprising an axial portion extending along the longitudinal axis and a radial portion extending substantially perpendicular to the longitudinal axis to engage a second surface at the second stroke end position;

a second rod having a first end and a second end extending along the longitudinal axis, the first end of the second rod is attached to a stroke limit element, the axial portion of the second ferromagnetic element is attached to the second end of the second rod; and a magnetic isolator element located between the first and second ferromagnetic elements.

9. The electromagnetic switch of claim 8, comprising:

a first ferromagnetic core defining a first opening adapted to fixedly receive the first electromagnetic coil; and a second ferromagnetic core comprising a second opening adapted to fixedly receive the second electromagnetic coil.

10. The electromagnetic switch of claim 9, wherein the first ferromagnetic core comprises:

a second opening extending along the longitudinal axis to slidably receive the axial portion of the first ferromagnetic element; and a third opening extending along the longitudinal axis to slidably receive a portion of the first rod.

11. The electromagnetic switch of claim 9, wherein the second ferromagnetic core comprises:

a second opening extending along the longitudinal axis to slidably receive the axial portion of the second ferromagnetic element; and a third opening extending along the longitudinal axis to slidably receive a portion of the second rod.

12. The electromagnetic switch of claim 1, comprising a spring to engage the third electrical contact member.

13. An electromechanical switch, comprising:

first and second ports adapted to receive an electrical signal;

a first solenoid defining a longitudinal axis adapted to receive a first energizing current;

a second solenoid positioned along the longitudinal axis adapted to receive a second energizing current;

an armature movable along the longitudinal axis relative to the first and second solenoids between a first stroke end position and a second stroke end position;

a piston extending along the longitudinal axis coupled to the armature, the piston comprising a first rod having a first end and a second end and an actuator member extending substantially perpendicular from the longitudinal axis attached to the first end of the first rod; a first electrical contact element coupled to the first port, the first electrical contact element is moveable from a first position to at least a second position in response to a force applied by the actuator member;

a second electrical contact element coupled to the second port, the second electrical contact element is moveable from a first position to at least a second position in response to a force applied by the actuator member;

a third electrical contact element to couple to at least one of the first and second electrical contact elements;

the first and second solenoids are adapted to selectively engage the first, second, and third electrical contact elements to selectively couple the first and second ports to an impedance element based on the energy state of the first and second solenoids; and first, second, and third dielectric carriers adapted to engage the respective first, second, and third electrical contact elements;

wherein, each of the first, second, and third dielectric carriers selectively transfer an actuation force to the first, second, and third electrical contact elements based on the energy state of the first and second solenoids.

14. The electromechanical switch of claim 13, wherein the first solenoid comprises:

a first electromagnetic coil positioned along the longitudinal axis and adapted to receive the first energizing current;

wherein the armature comprises a first armature movable along the longitudinal axis relative to the first electromagnetic coil to the first stroke end position when the first electromagnetic coil is energized; and wherein the actuator member is adapted to selectively engage the first, second, and third electrical contact elements.

15. The electromechanical switch of claim 13, wherein the second solenoid comprises:

a second electromagnetic coil positioned along the longitudinal axis and adapted to receive the second energizing current;

wherein the armature comprises a second armature movable along the longitudinal axis relative to the second electromagnetic coil to the second stroke end position when the second electromagnetic coil is energized; and wherein the piston comprises a second rod having a first end and a second end extending along the longitudinal axis, the first end of the second rod is attached to a stroke limit element.

16. The electromagnetic switch of claim 13, wherein the first, second, and third electrical contact elements are selectively coupled to any one of an open circuit, an attenuation circuit, and a short circuit based on the energy state of the first and second solenoids.

17. A method of switching a circuit using an electromagnetic switch, the method comprising:

selectively energizing first and second electromagnetic coils;

positioning a movable armature and a piston between a first stroke end position and a second stroke end position in response to the selective energizing of the first and second electromagnetic coils, the piston comprising a first rod having a first end and a second end and an actuator member extending substantially perpendicular from the longitudinal axis attached to the first end of the first rod;

positioning a first electrical contact element from a first position to at least a second position in response to a force applied by the actuator member;

positioning a second electrical contact element from a first position to at least a second position in response to a force applied by the actuator member;

coupling a third electrical contact element to at least one of the first and second electrical contact elements;

selectively engaging first, second, and third dielectric carriers to the respective first, second, and third electrical contact elements responsive to the selective energizing of the first and second electromagnetic coils; and selectively transferring an actuation force by the first, second, and third dielectric carriers to the first, second, and third electrical contact elements based on the energy state of the second electromagnetic coils.

18. An electromechanical switch, comprising:

a base portion comprising first and second electrical ports adapted to be electrically coupled in a plurality of modes;

a first electromagnetic coil defining a longitudinal axis and adapted to receive a first energizing current;

a second electromagnetic coil extending along the longitudinal axis in spaced apart relationship with the first electromagnetic coil, the second electromagnetic coil adapted to receive a second energizing current;

an armature movable along the longitudinal axis relative to the first and second electromagnetic coils between a first stroke end position and a second stroke end position;

a piston extending along the longitudinal axis coupled to the armature, the piston comprising a first rod having a first end and a second end and an actuator member extending substantially perpendicular from the longitudinal axis attached to the first end of the first rod;

a first electrical contact element coupled to the first electrical port, the first electrical contact element is moveable from a first position to at least a second position in response to a force applied by the actuator member; and a second electrical contact element coupled to the second electrical port, the second electrical contact element is moveable from a first position to at least a second position in response to a force applied by the actuator member;

wherein the armature comprises:

a first ferromagnetic element comprising an axial portion extending along the longitudinal axis and a radial portion extending substantially perpendicular to the longitudinal axis to engage a first surface at the first stroke end position, the axial portion of the first ferromagnetic element is attached to the second end of the first rod;

a second ferromagnetic element comprising an axial portion extending along the longitudinal axis and a radial portion extending substantially perpendicular to the longitudinal axis to engage a second surface at the second stroke end position;

a second rod having a first end and a second end extending along the longitudinal axis, the first end of the second rod is attached to a stroke limit element, the axial portion of the second ferromagnetic element is attached to the second end of the second rod; and a magnetic isolator element located between the first and second ferromagnetic elements; and wherein the first and second ports are selectively coupled in any one of open-terminated mode, attenuation mode, and a short circuit mode based on the energy state of the first and second electromagnetic coils.

19. The electromagnetic switch of claim 18, comprising:

a first ferromagnetic core defining a first opening adapted to fixedly receive the first electromagnetic coil; and a second ferromagnetic core comprising a second opening adapted to fixedly receive the second electromagnetic coil.

20. The electromagnetic switch of claim 19, wherein the first ferromagnetic core comprises:

a second opening extending along the longitudinal axis to slidably receive the axial portion of the first ferromagnetic element; and a third opening extending along the longitudinal axis to slidably receive a portion of the first rod.

21. The electromagnetic switch of claim 19, wherein the second ferromagnetic core comprises:

a second opening extending along the longitudinal axis to slidably receive the axial portion of the second ferromagnetic element; and a third opening extending along the longitudinal axis to slidably receive a portion of the second rod.

22. A switch, comprising:

a base portion comprising first and second electrical ports;

a first electromagnetic coil to receive a first energizing current;

a second electromagnetic coil to receive a second energizing current;

a first contact element coupled to the first port, the first contact element is moveable from a first position to at least a second position; and a second contact element coupled to the second electrical port, the second contact element is moveable from a first position to at least a second position in response to a force applied by the actuator member;

a piston comprising a first rod having a first end and a second end and an actuator member;

an armature coupled to the piston, wherein the armature is movable relative to the first and second electromagnetic coils between a first stroke end position and a second stroke end position and wherein the armature comprises:

a first ferromagnetic element comprising an axial portion extending along the longitudinal axis and a radial portion extending substantially perpendicular to the longitudinal axis to engage a first surface at the first stroke end position, the axial portion of the first ferromagnetic element is attached to the second end of the first rod;

a second ferromagnetic element comprising an axial portion extending along the longitudinal axis and a radial portion extending substantially perpendicular to the longitudinal axis to engage a second surface at the second stroke end position;

a second rod having a first end and a second end extending along the longitudinal axis, the first end of the second rod is attached to a stroke limit element, the axial portion of the second ferromagnetic element is attached to the second end of the second rod; and a magnetic isolator element located between the first and second ferromagnetic elements;

wherein the first and second ports are selectively coupled in any one of open-terminated mode, attenuation mode, and a short circuit mode based on the energy state of the first and second electromagnetic coils.

23. The switch of claim 22, comprising:

a first ferromagnetic core defining a first opening adapted to fixedly receive the first electromagnetic coil; and a second ferromagnetic core comprising a second opening adapted to fixedly receive the second electromagnetic coil.

24. The electromagnetic switch of claim 23, wherein the first ferromagnetic core comprises:

a second opening extending along the longitudinal axis to slidably receive the axial portion of the first ferromagnetic element; and a third opening extending along the longitudinal axis to slidably receive a portion of the first rod.

25. The electromagnetic switch of claim 23, wherein the second ferromagnetic core comprises:

a second opening extending along the longitudinal axis to slidably receive the axial portion of the second ferromagnetic element; and a third opening extending along the longitudinal axis to slidably receive a portion of the second rod.

* * * * *